US005325991A

United States Patent [19]

Williams

[11] Patent Number: 5,325,991

[45] Date of Patent: Jul. 5, 1994

[54] ADJUSTABLE MULTI-PURPOSE DRINK HOLDER WITH DETACHABLE INSULATOR BLANKET

[76] Inventor: Garry L. Williams, 2990 SW. Cornell Ave., Palm City, Fla. 33990

[21] Appl. No.: 154,234

[22] Filed: Nov. 18, 1993

[51] Int. Cl.[5] ..... B65D 25/34

[52] U.S. Cl. ..... 220/739; 220/903; 215/100.5; 215/12.1

[58] Field of Search ..... 220/739, 737, 903, DIG. 9; 215/100.5, 12.1, 12.2

[56] References Cited

U.S. PATENT DOCUMENTS

| | | | |
|---|---|---|---|
| 4,648,525 | 3/1987 | Henderson | 220/739 |
| 4,681,239 | 7/1987 | Manns et al. | 220/739 |
| 4,802,602 | 2/1989 | Evans et al. | 220/739 |
| 4,928,873 | 5/1990 | Johnson | 220/739 |
| 5,065,879 | 11/1991 | King | 220/739 |
| 5,169,025 | 12/1992 | Guo | 220/739 |

*Primary Examiner*—Joseph Man-Fu Moy

*Attorney, Agent, or Firm*—Norman Friedland

[57] ABSTRACT

A combined holder and support for receptacle such as drinking cups, cans, bottles, mugs comprising a flexible, resilient blanket having insolation qualities, wrapped in various diameter cylindrical open ended chambers adapted to releasably hold the receptacle and a thin and narrow elongated vertical support adapted to be bendable by hand into an L-shaped configuration and including velcro strips on the back face of the vertical support and inner surface of the blanket to support the blanket at various heights relative to the L-shaped configuration. Velcro strips at opposite ends of the blanket secure the blanket in the cylinder. The upper end of the vertical support is bendable to various configurations to accommodate the shape of the support to which it is being supported. Velcro strips at the bottom or top of the vertical support can be included to support the holder to a vertical or horizontal support or an aperture at the top end can be utilized to suspend the holder from a projection formed on a vertical support.

9 Claims, 5 Drawing Sheets

ADJUSTABLE MULTI-PURPOSE DRINK HOLDER WITH DETACHABLE INSULATOR BLANKET

TECHNICAL FIELD

This invention relates to a drink container holder and more particularly to a holder that includes a pliable yet rigid support and a detachable insulator blanket type holder.

BACKGROUND ART

There are numerous types of container holders disclosed in the literature and that are available that serve to hold drinking cups. Some of these containers are characterized by the fact that they are capable of being suspended and that they afford insulation qualities to either keep the liquid in the container cool or hot. Others provide means for suspending a drinking cup to a ledge or a platform such as are available in automobiles, boats and other vehicles. While others merely are capable of being hand held by the user and serve to keep the liquid in the container as close to the original temperature as possible over as long a period of time as possible.

For example, U.S. Pat. No. 4,181,765 granted to Harmony on Jan. 1, 1980 and entitled "Insulator for Canned Drinks" discloses an elongated sheet or blanket that is wrapped around a receptacle that has overlapping ends with a strip of adhesive to secure it in place. The insulator holds a drinking cup or can adapted to be hand carried.

U.S. Pat. No. 4,634,089 granted to Wright et al and entitled "Universal Cup Holder" discloses a two arm configuration attached to a back support defining an open channel cylinder receptacle adapted to receive different sized containers. The support structure in addition to the two arms consists of a back vertical member and a bottom horizontal member, each being adaptable to accept a strip of Velcro material.

U.S. Pat. No. 3,698,675 granted to Lerew et al on Oct. 17, 1972 entitled "Portable Holder" is a unitary rigid body defining a cylindrical cavity closed on the bottom for holding a container and a vertical back plate that includes an offset end portion that is adaptable to engage the back of a chair or the like to support the container holder.

U.S. Pat. No. 4,951,910 granted to March on Aug. 28, 1990 and entitled "Vertically Adjustable Velcro Strap Drink Holder" discloses a drink holder that includes a vertical L-shaped back with an offset to be attached to a ledge or the like for holding it in place and a complementary flat plate with a Velcro strip on its back face to engage a complementary velcro strip on the front face of the vertical member. This allows the two members to be mounted in different vertical positions to accommodate different sized containers. A pair of straps with Velcro strips extend laterally from the vertical back and are inserted between the two members and attached to one to hold the drink container that rests on the horizontal extension of the L-shaped back.

U.S. Pat. No. 4,915,337 granted to Iwasaki on Apr. 10, 1990 entitled "Flexible Cup Holder" discloses a flexible unit that includes a relatively narrow rigid U-shaped back with a horizontal and vertical flexible straps that engage the cup for support.

U.S. Pat. No. 4,708,273 granted to Grant on Nov. 24, 1987 entitled "Container Holder" discloses spaced closed and open hoops, a horizontal bottom support and a tab that is adapted to fit over the belt of the user. The container fits into the aperture formed by the spaced hoops and rests on the bottom support to be removed by the user to drink from the container.

Many of these configurations of container holders include various means for suspending a drinking cup at various locations. Some are for suspending the cup to the belt of the user and others are capable of being suspended in various types of vehicles. While they are, more or less, adequate for the particular purpose for which they have been designed they include certain deficiencies in a number of different respects. For example, some can only be utilized specifically for a single purpose for which they were designed. That is to say that the holder for the belt is limited to one who happens to be wearing a garment that will accommodate that particular unit. Other holders have brackets that are only capable of engaging certain configurations for supporting the holder. Many of the heretofore known holders that are adapted to be suspended in a moving vehicle are susceptible of swinging or swaying such that the contents can spill from the container chafe or mar the adjacent surface.

The container holder and support of my invention is characterized as being flexible and capable of many uses. That is to say, that it has many types of applications, as for example, it can be utilized to hold the container in various locations in an automobile, boat or other such vehicle. The back vertical support is made from material that is pliable yet sufficiently rigid to support the drinking cup. Consequently it can be bent at will with little effort by the user to be suspended at various types of supports and locations. As for example, it fits over the window slot or well or the back of the seat of an automobile or other type vehicle. It can also be bent to fit the belt of the user, or a hole in the top of the vertical back allows it to be supported to a nail, hook or the like in a vertical wall or door. Locating Velcro strips to the bottom of the horizontal portion of the bracket and the location where it will rest supports the drinking cup in the holder on any horizontal ledge.

The insulated blanket container holder can be detached from the holder and be hand held. It is contemplated within the scope of this invention that the blanket is a flat, flexible and resilient sponge material that is sufficiently long so that the ends overlap each other to form an open-ended chamber. Various sizes predicated by the amount of overlap will accommodate different sizes of drinking cups. Velcro strips at the edges will hold the blanket in the selected size to accommodate the drinking receptacle and allow the user to remove it as the need requires.

The holder support bracket is a substantially narrow thin flat elongated member that is fabricated from a pliable yet sufficiently sturdy material that allows the user to bend the member into various shapes to complement the support to which it is being attached. The holder support element, like the blanket container holder, carries attaching means for holding the container holder in position and for being attached to the various supports. In one of the embodiments it is contemplated that a hole at the proximal end of the holder support element allows the support to be held by a conventional nail or projection attached to the wall or the like. It is further contemplated by this invention that the outer surface of the blanket is adaptable of having indicia, logos printed thereon or having various colors for enhancing its appearance, identifying the owner of the holder, for advertising or for other like purposes.

SUMMARY OF THE INVENTION

An object of this invention is to provide an improved fluid container holder and support that is characterized as being flexible and having multiple uses.

A feature of this invention is that the vertical L-shaped support is fabricated from a relatively thin pliable but sufficiently rigid material so that the L- shape and an off-set can be hand bent at will to contour the back support so as to suspend the drink holder to various sized and contoured supports and support the receptacle at its bottom end. This supports the drinking receptacle and allows the user the remove it with one hand so as not to disturb the other hand which may be preoccupied doing something else, as, for example, driving a vehicle.

A feature of this invention is that the blanket is attached to the L-shaped support by a velcro strip bonded on the back face of the vertical support which engages a velcro strip bonded on the inner face of the blanket such that a portion of the outer face of the blanket acts as a buffer to an adjacent surface when suspended. The blanket can be moved vertically relative to the vertical back to accommodate various sizes of receptacles.

Velcro strips bonded at the overlapping edges of the blanket when wrapped defines an adjustable drink holder for various sized cups. The blanket is detachable from the L-shaped support so as to be used independently and is fabricated from a flexible and resilient sponge material that exhibits good insulation qualities and doesn't absorb water. The surface of the blanket is smooth to be adapted to have indicia, like logos and to be colored to enhance its appearance.

A feature of this invention is that the vertical L-shaped back support as described includes an aperture at the top of the support to be suspended by a conventional nail or hook extending from a vertical wall.

The foregoing and other features of the present invention will become more apparent from the following description and accompanying drawings.

BRIEF DESCRIPTION OF DRAWINGS

FIG. 7 is a perspective and phantom view exemplifying another embodiment of this invention where the vertical L-shaped back of the embodiment of FIG. 1 includes an aperture in the top portion for suspending it to a vertical wall or the like;

BEST MODE FOR CARRYING OUT THE INVENTION

Figure 1:
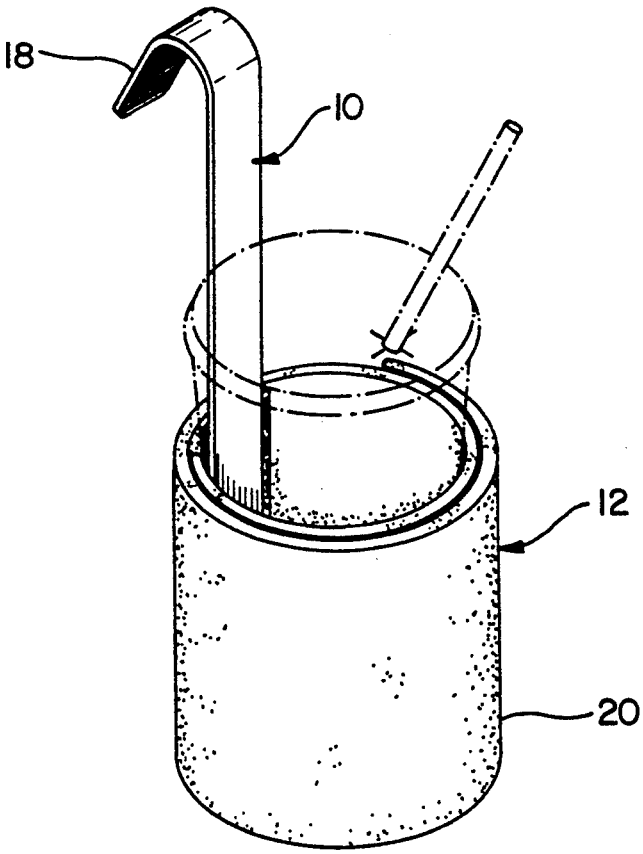
FIG. 1 is a perspective and phantom view illustrating this invention holding a drinking cup.

It will be understood that in the context of this invention the term drinking cup or receptacle includes without limitation, conventional drinking cups with or without lids, cans and bottles containing drinking fluids, and mugs or cups that include handles. Suffice it to say that this invention contemplates any receptacle in which the blanket of this invention is capable of being wrapped around, as will become apparent from the description to follow.

Referring next to all the FIGS. which illustrate the preferred embodiments of the drinking cup holder and support of this invention as comprising two principal elements, a L-shaped vertical back generally indicated by reference numeral 10 and an insulating blanket generally illustrated by reference numeral 12. Vertical back 12 is fabricated from a relatively thin and narrow elongate metallic element 14 that is bent laterally therefrom at the bottom to define a bottom support portion 16. The upper end 18 of the element 14 is capable of being bent into various shapes to accommodate the support from which it is to be suspended. Suitable material for the L-shaped back is commercially available sheet stock of aluminum 5052 that is 0.040 inch thick and cut into strips that measure fifteen (15) inches long by one and a half (1.5) inches wide.

The blanket 12 consists of a flexible sheet member 20 fabricated from commercially available sponge material that affords good insulation qualities and is hydrophobic. The size is cut from sheet goods that are a quarter (0.25) of an inch thick and is nineteen inches (19) long and five (5) inches wide.

Suitable Velcro strips are attache by any suitable bonding techniques say, by gluing or using double back tape, to both the L-shaped back 10 and the blanket 12 as to be described herein below. All the velcro strips can be bonded in a like manner.

A velcro strip 21 is attached to the inner face 22 of member 12 of blanket 20 substantially equi-distant from the overlapping edges 24 and 26 and extend substantially from the top edge 28 to substantially the bottom edge 30. A complementary velcro strip 31 being longer in length as velcro than velcro strip 21 is bonded to the back face of element 14. This allows the blanket 20 to be positioned at different vertical heights relative to the L-shaped back 10 to accommodate various sized drinking cups.

Complementary velcro strips in the context of this description alludes to the fact that one of the strips is a male element consisting of hooks and the other Joining strip is a female element consisting of loops. Unless otherwise stated the location of the male velcro strip relative to the female velcro strip is completely arbitrary and its function is to releasably secure two elements together. Sheets of Velcro are commercially available and are readily cut into the sized strips desired.

Blanket 12 includes a velcro strip 32 suitably bonded to the outer face of element 20 at the overlapping edge 24 and the complementary velcro strip 34 is suitably bonded to inner face of the opposite overlapping edge 26. It is completely arbitrary as to whether the velcro strip is attached to the inner face of one edge or the other and likewise for the outer face. However one to the velcro strips (velcro strip 32 in this embodiment) is disclosed as being sufficiently long to extend a substantial extent along the outer face of the blanket 20. The purpose for this is to allow the blanket to be adjusted to various diameters to accommodate various sized drinking cups. Both velcro strips 32 and 34 are dimensioned substantially as wide as blanket 20 to assure a good and reliable support for the cup when it is formed into the holding receptacle. As noted in FIGS. 1 and 2, the diameter of the blanket is adjusted for a big sized drinking cup and a small sized drinking cup, respectively.

As is apparent from the foregoing, when the blanket 12 is attached to the L-shaped back support and formed in a receptacle for accepting a drinking cup the drinking cup will rest on the horizontal portion 16 which is sufficiently rigid to support the cup vertically and the attachment of the blanket at the edges serves to hold the cup in place.

Figure 2:
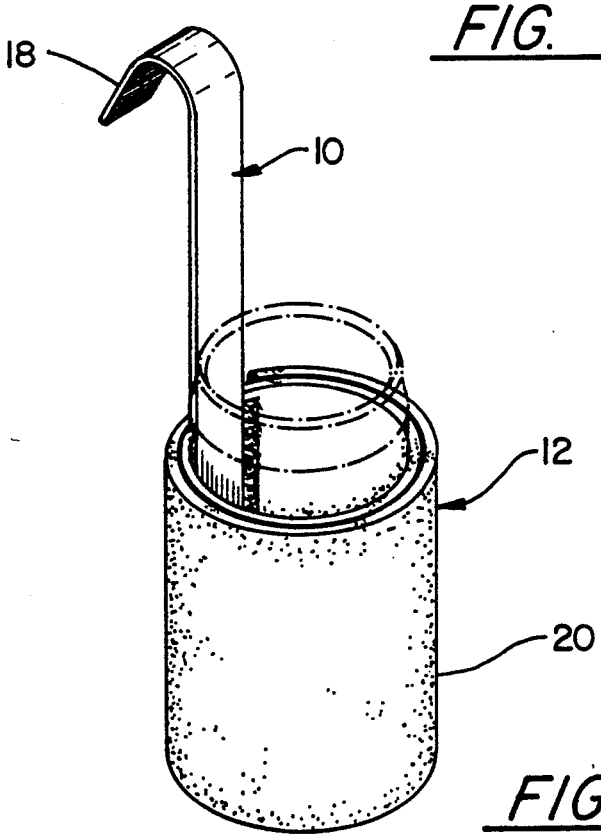
FIG. 2 is a perspective and phantom view of the embodiment depicted in FIG. 1 adjusted to fit a smaller cup.
Figure 3:
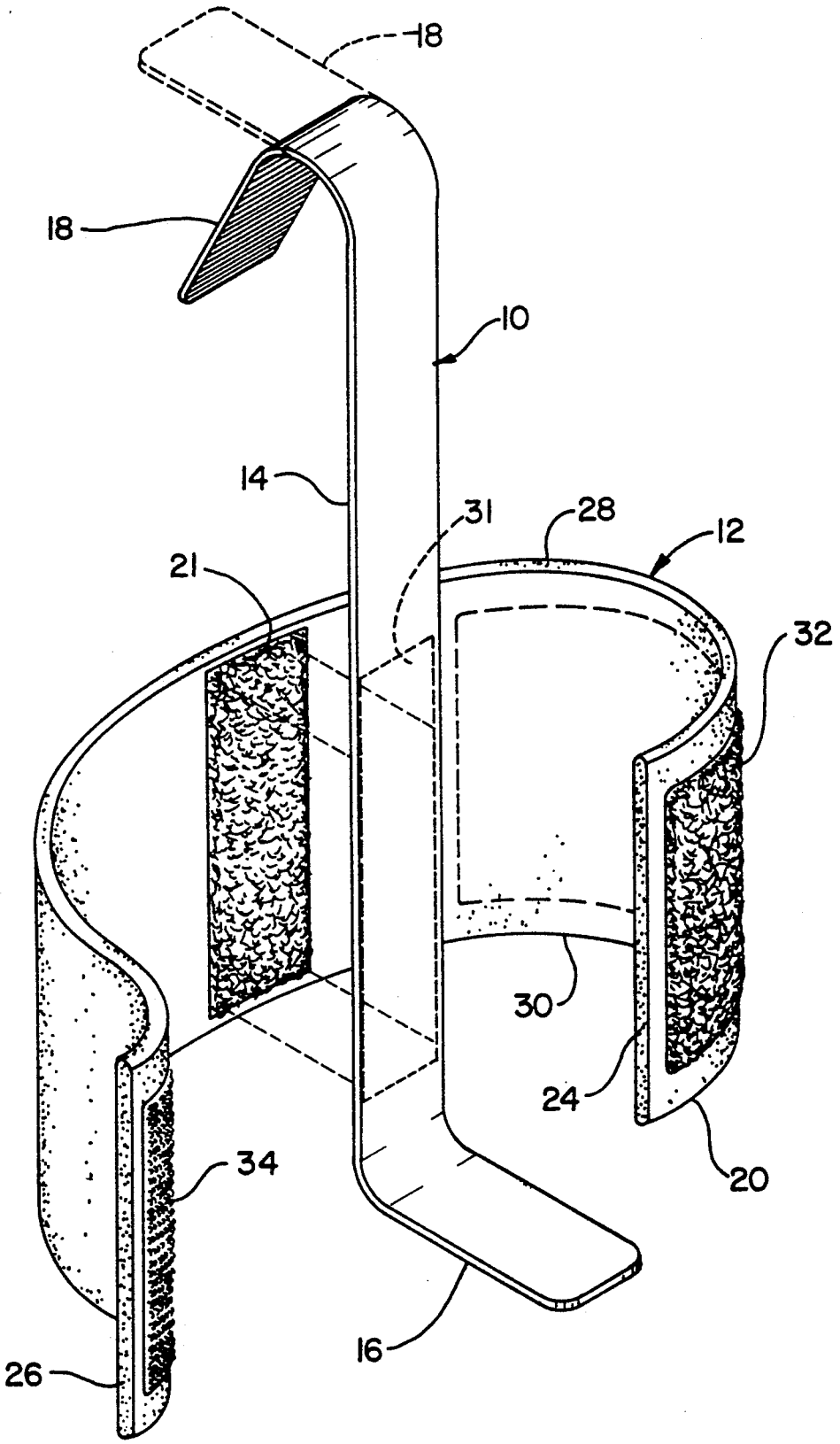
FIG. 3 is an exploded view in perspective illustrating the details of this invention.
Figure 4:
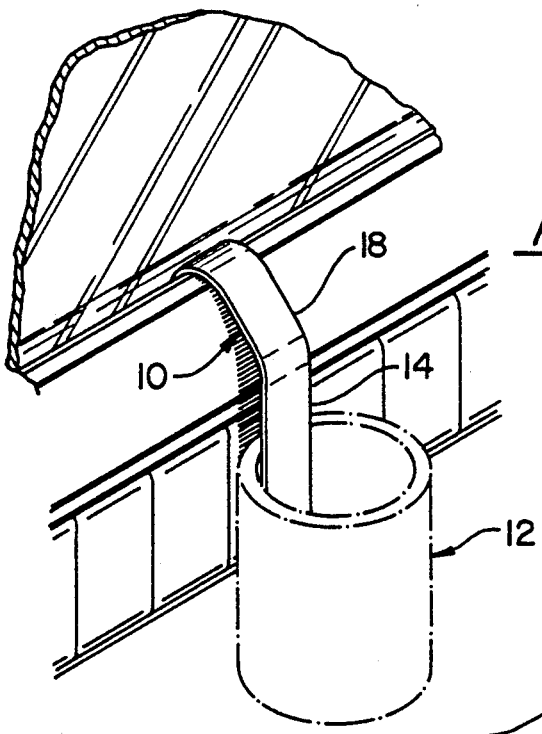
FIG. 4 is a perspective and phantom view of the embodiment depicted in FIG. 1 adapted to be suspended from the well of a window in a vehicle.

FIG. 4 exemplifies the embodiment of FIG. 1 when the overlapping portion of the upper portion 18 of the L-shaped back plate is bent to be inserted into the well of a roll down window mounted in the door of a vehicle. As noted the upper portion 18 may include several bends at judicious locations to accommodate the contours of the back face of the door supporting the window. It is important to note that in accordance with this invention that the outer face of member 20 the blanket 12 bears against the face of the door. This is particularly important when suspended in a moving vehicles as it acts as a friction surface that prevents the cup from swinging and inadvertently spilling the drink. It also acts as a buffer and prevents marring or wearing of the adjacent surface.

Figure 5:
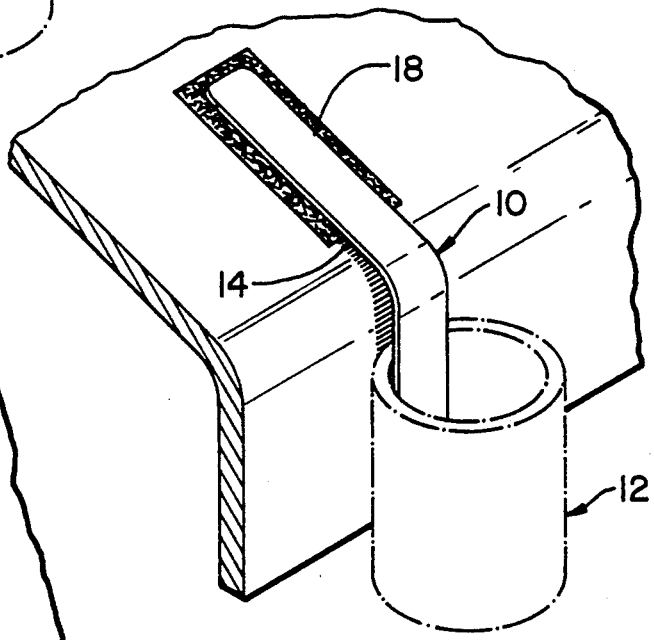
FIG. 5 is a perspective and phantom view of the embodiment depicted in FIG. 1 adapted to be suspended from a horizontal surface as, for example, the dash-board of a vehicle.
Figure 6:
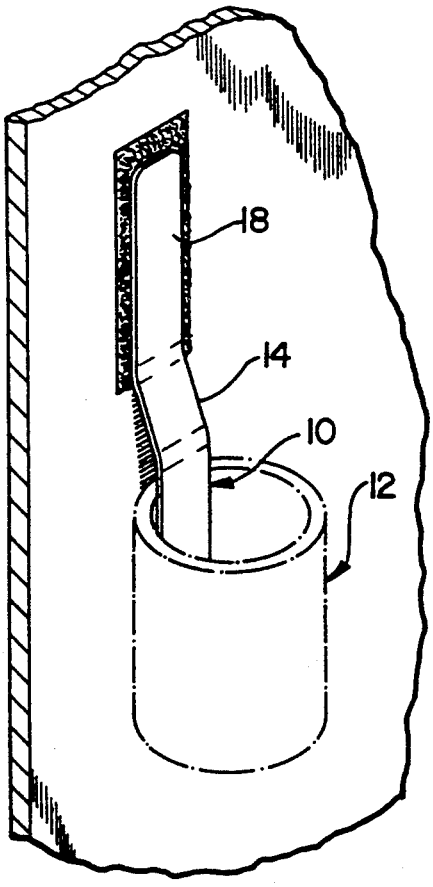
FIG. 6 is a perspective and phantom view of the embodiment depicted in FIG. 1 adapted to be suspended from a vertical wall.

FIGS. 5 and 6 exemplify embodiments where the embodiment of FIG. 1 is modified to include a velcro strip at the outer face of the upper portion 18 of the L-shaped back 10. A complementary velcro strip is attached to a horizontal surface as, for example the dash-board of a vehicle in FIG. 5 and attached to a vertical wall as depicted in FIG. 6.

Figure 7:
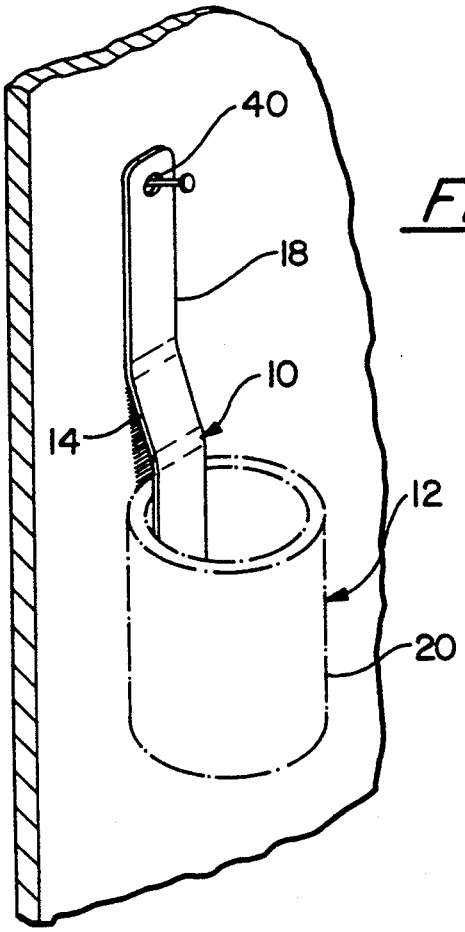

FIG. 7 exemplifies an embodiment where the embodiment depicted in FIG. 1 is modified to include aperture 40 located at the upper end of portion 18 of the L-shaped back 10 adapted to accept a nail or hook or the like extending form a vertical wall for supporting the drinking cup holder.

Figure 8:
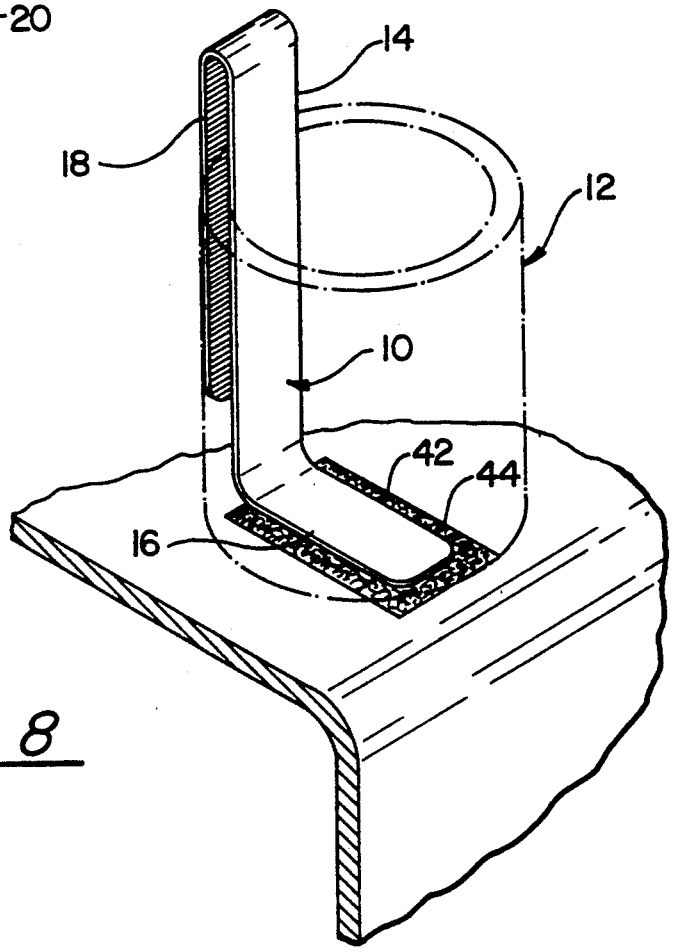
FIG. 8 is a perspective and phantom view of the embodiment depicted in FIG. 1 adapted to be mounted on a horizontal support as, for example, the dash-board of a vehicle.

FIG. 8 exemplifies an embodiment where the embodiment depicted if FIG. 1 includes a velcro strip 42 attached to the bottom surface of the horizontal extension portion 16 to be supported by a complementary velcro strip 44 suitably bonded to the horizontal surface.

Figure 9:
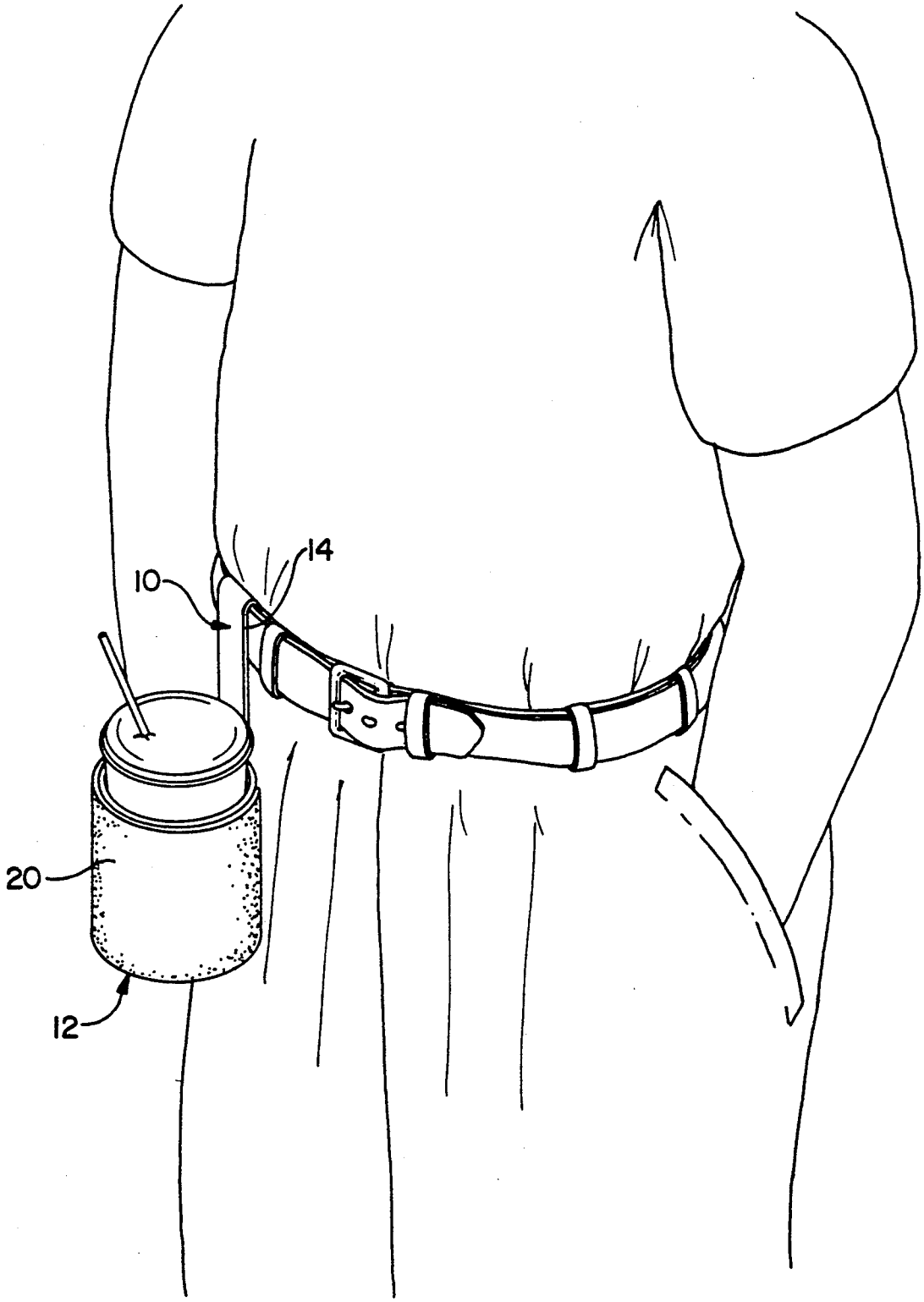
FIG. 9 is a view in perspective of the embodiment of FIG. 1 adapted to be suspended by to the belt of the person wearing it.

FIG. 9 illustrates the embodiment depicted in FIG. 1 where the off-set at the upper portion 18 is bent to define a lip that fits over the belt or other portion on the garment of the wearer.

It is apparent from the foregoing that in each of the embodiments the blanket is detachable from the supporting member and hence, is available to be used independently of the L-shaped back. The foam material is sufficiently resilient that when the edges are overlapped and sized to form the desired diameter receptacle holder, it provides sufficient force and friction to retain the cup and afford good insulation. It has been found that in actual tests, with cups filled with equal amounts of ice with and without the blanket, the insulated cup with the blanket retained the temperature of the fluid five (5) times longer than the other cup without the blanket. The fact that the blanket is detachable and the bracket is flat lends itself to be compact and facilitates the storage of the unit when not in use. Because it is compact it also lends itself to be retained in a compact bag and easily displayed in vertical snap on racks for display and selling purposes.

Although this invention has been shown and described with respect to detailed embodiments thereof, it will be appreciated and understood by those skilled in the art that various changes in form and detail thereof may be made without departing from the spirit and scope of the claimed invention.

I claim:

1. A reusable and adjustable combined receptacle holder and support means, said holder means of said reusable adjustable combined receptacle holder and support means including a flexible, resilient blanket adapted to be wrapped into a cylinder defining an open ended chamber to removeably receive said receptacle, said support means of said reusable and adjustable combined receptacle holder and support means including a thin and narrow elongated hand bendable member bendable into an L-shaped configuration, a velcro strip bonded on the back face of said hand bendable member, a complementary velcro strip bonded on the inner surface of said blanket adapted to be releasably secured to said back face of said bendable member adjacent said bent L-shaped configuration, a pair of complimentary velcro strips bonded on the adjacent front edges of said blanket, one of said pair of complementary velcro strips being mounted on the outer side of said blanket and the other of said pair of complementary velcro strips mounted on the inner side of said blanket for securing said blanket into said cylinder, and the upper end of said bendable member adapted to be bent into a configuration complementing the configuration to which it can be releasably be secured, whereby when in the assembled condition the blanket is wrapped around said bendable member and is in frictional engagement with the surface of the support to which said combined holder and support means is being supported.

2. A reusable and adjustable combined receptacle holder and support means as claimed in claim 1 wherein said elongated bendable member is formed from an aluminum material.

3. A reusable and adjustable combined receptacle holder and support means as claimed in claim 2 wherein said aluminum material is 5052 aluminum.

4. A reusable and adjustable combined receptacle holder and support means as claimed in claim 2 wherein said velcro strip mounted on the front edge of the inner surface of said blanket includes an extended width to configure said blanket into cylinders having different diameters to accommodate the diameter of the receptacle being held.

5. A reusable and adjustable combined receptacle holder and support means as claimed in claim 4 wherein the velcro strip mounted on the back face of said bendable member is wider than the width of said blanket, whereby said blanket when attached to said bendable member can be releasably supported at various axial positions relative to the L-shaped configuration.

6. A reusable and adjustable combined receptacle holder and support means as claimed in claim 4 wherein the bendable member includes an aperture formed in the upper end remote from said L-shaped configuration adapted to be vertically supported by a projection extending from a vertical wall.

7. A reusable and adjustable combined receptacle holder and support means as claimed in claim 4 wherein a releasable bonding means is mounted on the outer face of said bendable member at the L-shaped configuration to be supported on a horizontal support.

8. A reusable and adjustable combined receptacle holder and support means as claimed in claim 4 including a releasable bonding means mounted on the back face of said bendable member adjacent the upper end remote from the L-shaped configuration to support said combined holder and support means to a vertical wall.

9. A reusable and adjustable combined receptacle holder and support means as claimed in claim 1 wherein said blanket is an insulator.

* * * * *